US010232967B2

(12) United States Patent
Baroncini

(10) Patent No.: US 10,232,967 B2
(45) Date of Patent: Mar. 19, 2019

(54) DISTRIBUTOR UNIT FOR TABLETS OR CAPSULES

(71) Applicant: I.M.A. INDUSTRIA MACCHINE AUTOMATICHE S.P.A., Ozzano Dell'Emilia (IT)

(72) Inventor: Ivano Baroncini, Castel San Pietro Terme (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 626 days.

(21) Appl. No.: 14/415,463

(22) PCT Filed: Jul. 16, 2013

(86) PCT No.: PCT/IB2013/001537
§ 371 (c)(1),
(2) Date: Jan. 16, 2015

(87) PCT Pub. No.: WO2014/013310
PCT Pub. Date: Jan. 23, 2014

(65) Prior Publication Data

US 2015/0203226 A1 Jul. 23, 2015

(30) Foreign Application Priority Data

Jul. 17, 2012 (IT) ..... MI2012A1243

(51) Int. Cl.
*B65B 35/08* (2006.01)
*B65B 5/10* (2006.01)
*B65B 9/04* (2006.01)

(52) U.S. Cl.
CPC ..... *B65B 35/08* (2013.01); *B65B 5/103* (2013.01); *B65B 9/045* (2013.01); *B65B 2230/02* (2013.01)

(58) Field of Classification Search
USPC ..... 221/1, 365
See application file for complete search history.

(56) References Cited

U.S. PATENT DOCUMENTS 4,094,129 A * 6/1978 List ..... A61J 7/02 198/418
6,510,676 B1 * 1/2003 Gauthier ..... B65B 35/00 53/246

(Continued)

FOREIGN PATENT DOCUMENTS

DE 102005046049 A1 3/2007
EP 0224017 A1 6/1987

(Continued)

OTHER PUBLICATIONS

International Search Report and Written Opinion From PCT/IB2013/001537 dated Oct. 30, 2013.

*Primary Examiner* — Michelle Lopez
*Assistant Examiner* — Chinyere Rushing-Tucker
(74) *Attorney, Agent, or Firm* — Calfee Halter & Griswold LLP

(57) ABSTRACT

Distributor unit for transferring tablets and putting them in order, from a loading zone to an unloading zone, and for distributing the tablets in an orderly and controlled manner in organized blisters present in a blister strip. The distributor unit comprises belt-type feed means in which a feed belt is provided, along at least part of its length, and along at least part of its width, with a plurality of open through seatings each having at different times sizes coordinated with those of the tablets to be distributed, said open through seatings having a transverse interaxis about equal to, and a longitudinal interaxis equal to or less than, that of the blisters in the blister strip.

19 Claims, 5 Drawing Sheets

(56) References Cited

U.S. PATENT DOCUMENTS

| | | | | |
|---|---|---|---|---|
| 6,648,575 | B2 * | 11/2003 | Baroncini | B65B 35/34<br>414/300 |
| 2001/0052218 | A1 * | 12/2001 | Baroncini | B65B 9/045<br>53/235 |
| 2004/0237468 | A1 * | 12/2004 | Baroncini | B65B 1/08<br>53/251 |
| 2005/0230001 | A1 * | 10/2005 | Monti | B65B 5/103<br>141/129 |
| 2007/0151205 | A1 * | 7/2007 | Monti | B65B 5/103<br>53/250 |
| 2008/0142402 | A1 * | 6/2008 | Kames | G07F 17/0092<br>206/559 |
| 2009/0133362 | A1 * | 5/2009 | Bentele | B65B 5/103<br>53/54 |
| 2009/0260330 | A1 * | 10/2009 | Hess | B65B 35/06<br>53/493 |
| 2010/0107555 | A1 * | 5/2010 | Yuyama | B65B 5/103<br>53/131.2 |
| 2010/0242415 | A1 * | 9/2010 | Ehrat | B65B 5/105<br>53/474 |
| 2011/0030314 | A1 * | 2/2011 | Baroncini | B65B 5/103<br>53/254 |
| 2013/0008131 | A1 * | 1/2013 | Baroncini | B65B 59/04<br>53/250 |

FOREIGN PATENT DOCUMENTS

| | | | |
|---|---|---|---|
| WO | 2008/049119 | A1 | 4/2008 |
| WO | 2009/115445 | A1 | 9/2009 |

* cited by examiner

DISTRIBUTOR UNIT FOR TABLETS OR CAPSULES

CROSS-REFERENCE TO RELATED APPLICATIONS

This application is the U.S. national phase entry of PCT/IB2013/001537, with an international filing date of 16 Jul. 2013, which claims the benefit of Italian Application Serial No. MI2012A001243, with filing date of 17 Jul. 2012, the entire disclosures of which are fully incorporated herein by reference.

FIELD OF THE INVENTION

The present invention concerns a distributor unit which provides to continuously transfer products such as tablets, pills, capsules or other similar or comparable product, from a delivery element, which contains them in a haphazard manner, to a subsequent user device, that is, organized container means, such as a blister strip or blister pack, where they are disposed in an organized and desired order in suitable blisters or seatings.

In particular, the present invention concerns how a plurality of tablets, pills, capsules or similar products, which here and hereafter in the description and the claims shall be indicated by the term tablets, are taken by a feed belt and deposited in said blisters or seatings.

BACKGROUND OF THE INVENTION

Distributor units are known, which feed one or more blister strips by means of transfer channels, below which the blister strips slide.

A distributor unit by the Applicant is also known, which uses a rotating disc to feed a blister strip which translates along a direction tangent to said disc.

Although such distributor units allow to obtain high delivery rates, there is a constant request from the market to increase the productivity of these machines.

This has led the Applicant to study, experiment and achieve a new type of distributor unit, the first purpose of which is to obtain a greater productivity compared with that obtainable with distributor units of the known type.

WO-A-2008/049119 discloses an apparatus to package loose food products such as sweets, candy, chewing gum or similar, which are printed without contact with an edible ink. The apparatus comprises a contactless printer, a closed-ring rotating conveyor made to rotate by pulleys and a belt-type packaging formed by compartments, such as cups, recesses, blisters, into which the products are unloaded and positioned. A hopper is provided which feeds the products haphazardly onto an upper segment of the closed-ring path of the conveyor belt. The conveyor belt comprises blind pockets, that is, closed at the lower part, which receive and support the products fed by the hopper. The pockets have a pre-established depth, which depends on the type of product they receive. An aligner device is provided to correctly position the haphazard products into said pockets on the upper segment of the closed-ring path of the conveyor belt. Moreover, guides are provided disposed externally along an arc of a circle of the path of the conveyor belt around the pulleys, which, also closing the pockets at the upper part, keep the products inside the pockets until the products are upended and reach, in the lower segment of the closed-ring path of the conveyor belt, the position in which they are unloaded into the compartmentalized package, downstream of which a sealing device is provided. This known apparatus, however, is bulky and costly, and is also limited in its fitting possibilities and of adapting to the type of tablet, due, for example, to the provision of blind pockets with a fixed depth. It is also limited in its possibility of adapting to the type of blister strip.

Another purpose of the present invention is to obtain a compact distributor unit, which allows to reduce bulk and production costs and which guarantees uniformity and reliability of production.

It is also a purpose to obtain a distributor unit which is easy to maintain, fit and adjust both to the type of tablet and also to the type of blister strip.

It is also a purpose of the invention to make a distributor unit which is efficient and versatile, so as to be usable for a wide range of products and a wide range of desired productivity.

Another purpose is to guarantee a constant high qualitative and quantitative delivery.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a distributor unit according to the present invention is suitable to transfer tablets and to put them in order, from a loading zone to an unloading zone, in order to distribute them in an orderly and controlled manner in organized blisters present in a blister strip.

According to one feature of the present invention, the distributor unit comprises belt-type feed means, in which a feed belt is provided, along at least part of its length, and along at least part of its width, with a plurality of open through seatings each having sizes coordinated with those of the tablets to be distributed.

The open through seatings have a transverse interaxis about equal to that of the blisters of the blister strip.

In some forms of embodiment, a support plane is provided, situated immediately under the feed belt in order to support the tablets received from the open through seatings at least for a segment of trajectory between the loading zone and the unloading zone.

According to a variant, the longitudinal interaxis of the open through seatings is less than the longitudinal axis of the blisters that accommodate the tablets.

According to one form of embodiment of the invention, the belt-type feed means are configured to move the feed belt so that it is linearly adjacent to the blister strip along at least a common rectilinear segment, an unloading zone being provided where the tablets are delivered to the blister strip.

In a variant, the feed belt and the blister strip are moved parallel to each other in the same direction and sense.

According to another feature of the invention, the feed belt follows a closed-ring trajectory having at least a rectilinear segment, comprised between the zone where the tablets are loaded into the open through seatings of the feed belt and the unloading zone.

In cooperation with the feed belt, the loading zone has a delivery element which unloads the tablets onto the feed belt.

The unloading zone is structured so that the feed belt delivers the tablets quickly to the blister strip, positioning them in the appropriate blisters.

The variant in which the longitudinal interaxis of the open through seatings of the feed belt is less than the longitudinal interaxis of the blisters present in the blister strip, allows to transport a larger number of tablets in a unit of time, therefore allowing to increase the translation speed of the blister strip and consequently productivity.

The rectilinear movement, parallel and in the same direction, of the feed belt and the blister strip achieves a rapid, efficient and reliable distribution of the tablets into the blisters.

In the variant where there are two differentiated speeds, once the speed of the blister strip has been set, which determines productivity, the greater the ratio between the interaxis between the blisters and the interaxis between the open through seatings, the lower the speed of the feed belt.

The loading and unloading of the tablets along a rectilinear segment causes all the longitudinal rows of blisters to be fed at the same speed.

The tablets can be transferred from the feed belt to the blister strip by gravity. In particular, as the through seatings are provided open, the tablets, once the support of the support plane below is removed, pass freely through the open through seatings, dropping into the blister strip. Furthermore, thanks for example to the configuration described above of the open through seatings of the feed belt, in cooperation with the lower support plane, the distributor unit of the present invention is more versatile and allows greater fitting possibilities and of adapting to the type of tablet, and also to the type of blister strip.

According to a variant, jets of air or other fluids contribute to the transfer of the tablets.

According to another variant, brush means contribute to the transfer.

In a variant of the present invention, in correspondence to the unloading zone, deflector means, located downstream of the support plane, deflect the path of the blister strip vertically toward the feed belt, facilitating the positioning of the tablets inside the blisters of the blister strip.

It is within the spirit of the invention to provide that the feed belt can be continuous, in sections, with plates or other, and that it is moved by means of movement means to which friction means or engaging means are associated.

It is also a feature of the invention to provide that the distributor unit in question is modular with respect to a single motor base. This allows to install feed belts with the desired number of rows of open through seatings, so as to render them coherent with the width of the blister strips.

The invention has the advantage of obtaining much higher values of productivity compared to those obtainable with known distributor units, without having to intervene on the overall bulk.

The present invention also concerns a method to transfer tablets and put them in order from a loading zone to an unloading zone and to distribute the tablets in an orderly and controlled manner in organized blisters present on a blister strip. The method of the present invention provides to feed the tablets by means of feed means which house the tablets in a plurality of open through seatings of a feed belt, each with sizes coordinated to those of the tablets to be distributed and a transverse interaxis about equal to, and a longitudinal interaxis equal to or less than, that of the blisters in the blister strip.

BRIEF DESCRIPTION OF THE DRAWINGS

These and other characteristics of the present invention will become apparent from the following description of some forms of embodiment, given as a non-restrictive example with reference to the attached drawings wherein.

DETAILED DESCRIPTION OF SOME FORMS OF EMBODIMENT

Figure 1:
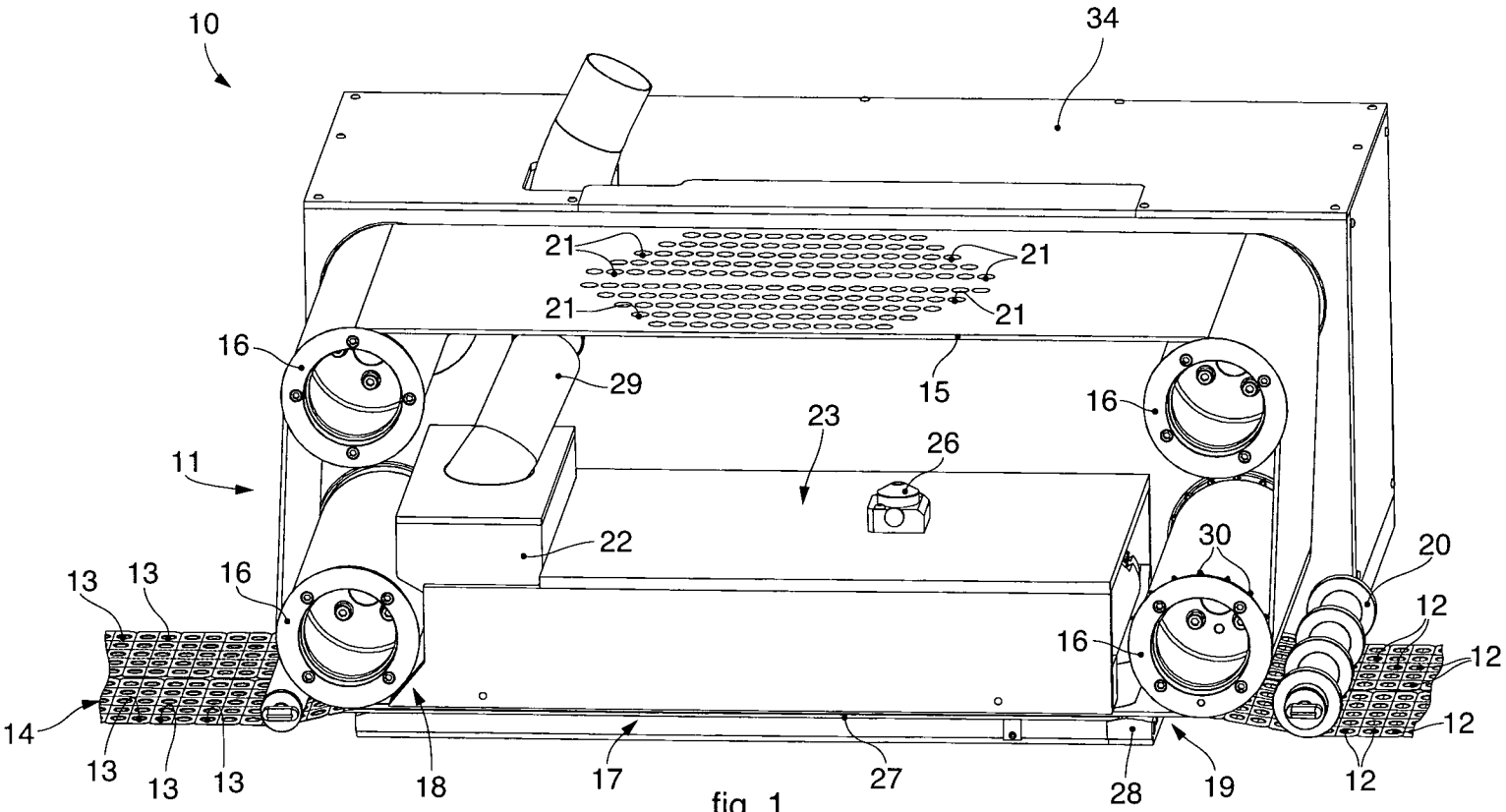
FIG. 1 is a three-dimensional view of a distributor unit according to the present invention.
Figure 2:
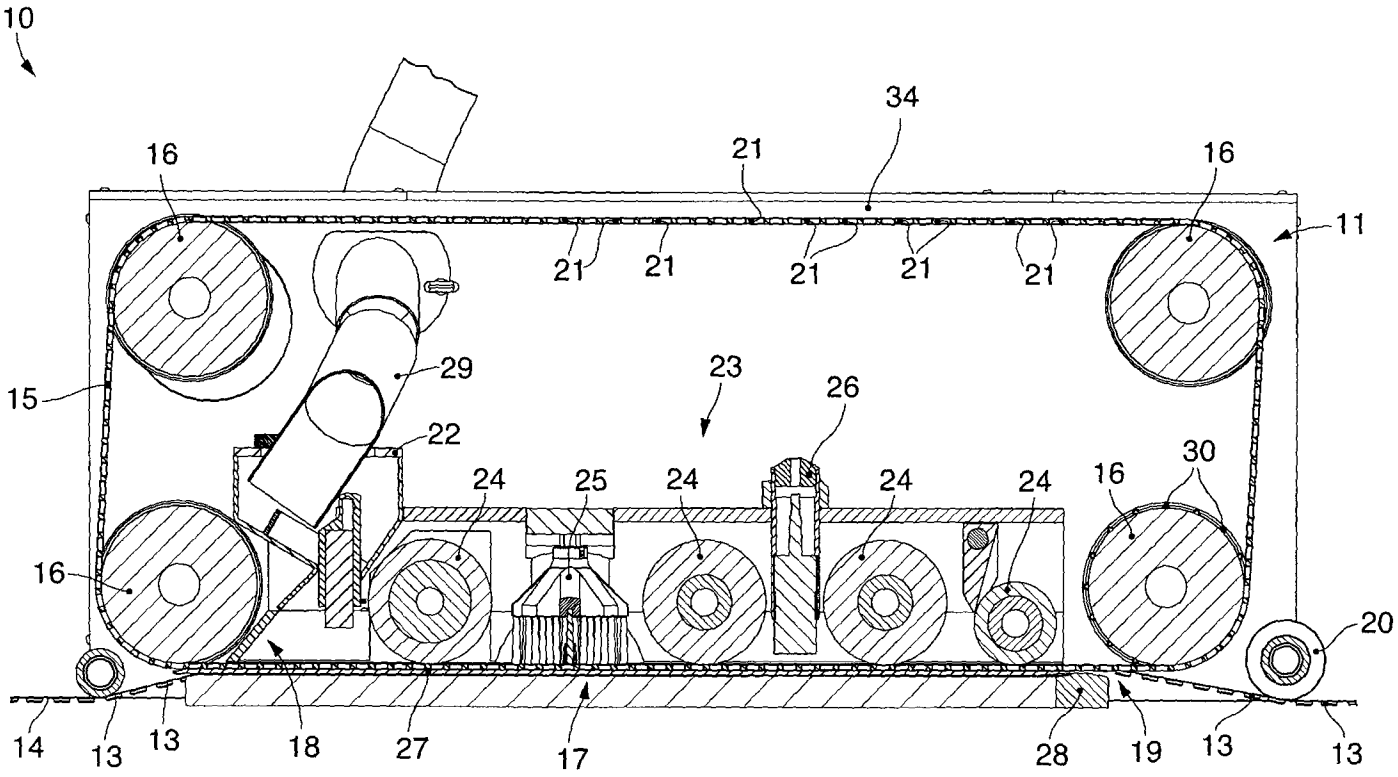
FIG. 2 is a section view of FIG. 1.

With reference to FIGS. 1 and 2, a distributor unit 10 comprises belt-type feed means 11 with the function of distributing tablets 12, in an ordered and controlled manner, inside compartments, or blisters 13, of a blister strip 14.

The belt-like feed means 11 comprise a feed belt 15, of the endless type.

The feed belt 15 can be made of metal, plastic or a combination of both materials.

The feed belt 15 cooperates with a series of guide rolls 16. The guide rolls 16 act as movement and tensioning means and cooperate with the feed belt 15 to move it along a trajectory, which can be open, or a closed-ring type, as in the case in FIG. 1. In other words, the feed belt 15 can be for example open, or the closed-ring type. This trajectory or path, along which the feed belt 15 can be moved, has at least a rectilinear segment 17, for example a lower rectilinear segment, comprised between a loading zone 18 and an unloading zone 19.

In some forms of embodiment, the loading zone 18 and the unloading zone 19 can be provided in correspondence to, that is, they can be aligned along, the same rectilinear segment of the feed belt 15, such as for example the segment corresponding to the rectilinear segment 17 of the path completed by the feed belt 15. In possible implementations, the segment of feed belt 15, in correspondence to which there is the loading zone 18 and the unloading zone 19, is a segment in a lower position in the distributor unit 10.

The blister strip 14 exiting from the unloading zone 19 cooperates with a deflector roll 20 and moves, along the rectilinear segment 17, in the same direction as the feed belt 15, parallel to and below it.

The guide rolls 16 can confer any type of shape, for example trapezoidal or triangular etc., on the feed belt 15 and its closed-ring trajectory.

As shown in the attached drawings, along at least part of its length and at least in part along its width, the feed belt 15 has a plurality of open through seatings 21, each having sizes coordinated with those of the tablet 12 which it has to transfer on each occasion. The open through seatings 21 are configured to receive the tablets 12.

Figure 4:
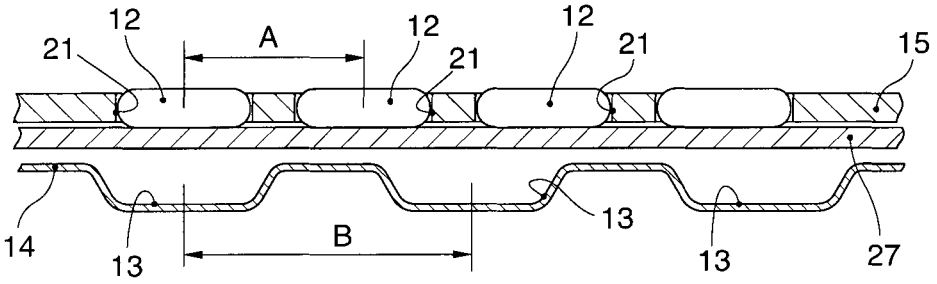
FIG. 4 is a schematic section view of one form of embodiment of a detail in FIG. 2.
Figure 6:
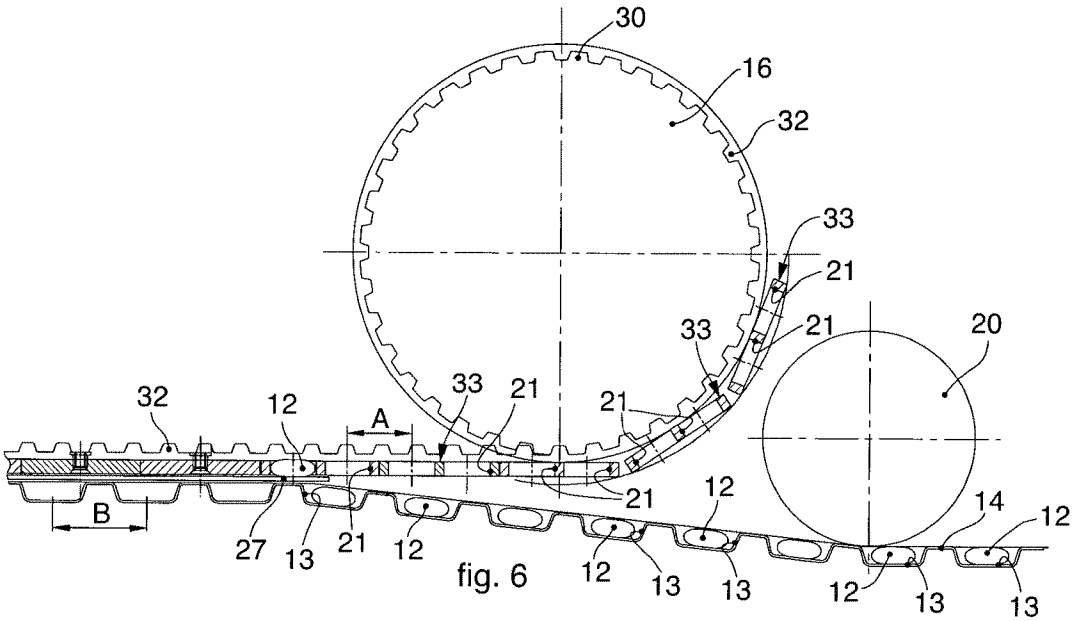
FIG. 6 is a section from VI to VI of FIG. 5.

The transverse interaxis between the open through seatings 21 is the same as that of the blisters 13 on the blister strip 14. In a longitudinal direction, that is, in the direction of motion, the longitudinal interaxis A between the open through seatings 21 of the feed belt 15, in the case shown, is less than the longitudinal interaxis B between the blisters 13 of the blister strip 14 (FIGS. 4 and 6).

Longitudinal grooves, and lead-ins in each open through seating 21, can be provided in the feed belt 15 to facilitate the entrance of the tablets 12 into the open through seatings 21.

In general (FIG. 2), the functioning of the distributor unit 10 in question provides that a delivery element, for example a hopper 22, or similar feed means, receives the tablets 12 from a pipe 29 and then pours them in a disorderly manner onto the feed belt 15, in correspondence to the loading zone 18.

In variant embodiments, the pipe 29 distributes the tablets 12 onto the segment of the feed belt 15 which is adjacent to the blister strip 14. For example, in the case of the closed-ring type feed belt 15, the segment which receives the tablets 12 from the pipe 29 is the lower segment of the closed-ring path. In possible implementations, the loading zone 18 and the unloading zone 19 are disposed in correspondence to this lower segment of the closed-ring path of the feed belt 15, that is, they are on one side and the other of the same lower segment of the feed belt 15.

The tablets 12 dispose themselves naturally in the open through seatings 21 in an orderly manner by means of ordering means 23 configured to position a single tablet 12 into each of the open through seatings 21, so that in all the open through seatings 21 there is one and only one tablet 12.

In forms of embodiment described with reference to FIGS. 1, 2 and 7 for example, in which the feed belt 15 is the closed-ring type, at least the ordering means 23 are for example included inside the closed-ring trajectory or path, in particular inside the corresponding linear segment for example, of the feed belt 15, that is, they are comprised in the bulk delimited by the feed belt 15. Possibly, with reference for example to forms of embodiment described using FIGS. 1, 2 and 7, at least part of the hopper 22 can also be included inside the closed-ring path of the feed belt 15.

In forms of embodiment described with reference to FIGS. 1, 2 and 7 for example, the ordering means 23 can extend between the loading zone 18 and the unloading zone 19, that is they can involve the space provided between the loading zone 18 and the unloading zone 19, above the corresponding rectilinear segment 17 which the feed belt 15 travels over on each occasion. For example, the ordering means 23 can be provided immediately downstream of the hopper 22 which can be provided at the loading zone 18.

The minimum or basic ordering means 23 can have at least a rotating brush with a horizontal axis 24.

According to a variant, there is at least one rotating brush with a vertical axis 25.

According to another variant at least one linear brush is provided orthogonal or aslant with respect to the axis of the feed belt 15.

These variant means, by themselves or in association, are means to level the tablets 12 and correctly place them in the open through seatings 21.

Finally, the tablets are each deposited inside a blister 13 of the blister strip 14, as will be described in detail hereafter.

In the form of embodiment, shown by way of example in FIG. 2, the ordering means 23 are defined by four brushes with a horizontal axis 24, one brush with a vertical axis 25 and by a control device 26.

The latter functions as a control mean and has the function of measuring the height of the layer of tablets 12 disposed on the feed belt 15, in order to consequently manage the behavior and position of the brushes 24, 25.

In order to prevent the tablets 12 from escaping due to gravity from the open through seatings 21, along the rectilinear segment 17 and below the feed belt 15 a support plane 27 is disposed, parallel to the feed belt 15 and on which the tablets 12 slide. The support plane 27 can be configured to support the tablets 12 received from the open through seatings 21 at least for a segment of trajectory between the loading zone 18 and the unloading zone 19. In said segment of trajectory, therefore, the support plane 27 can be provided between the blister strip 14 and the feed belt 15. In possible variant forms of embodiment, the distance between the support plane 27 and the feed belt 15 can be adjusted, in order, for example, to adapt to the type and/or size of the tablets 12 received in the open through seatings 21.

The support plane 27 ends in proximity to the unloading zone 19.

A deflector element 28, positioned downstream of the support plane 27, is associated with the unloading zone 19 and cooperates with the blister strip 14 to deflect it upward toward the feed belt 15. In this way, and because of the way the reciprocal speeds are calibrated, the blisters 13 are each disposed so as to receive one tablet 12, which exits due to gravity from the corresponding open through seating 21.

In the variant solutions shown in FIGS. 1-3 and 7, the running and the drawing of the feed belt 15 are carried out by engaging means, which are associated with the guide rolls 16 and guarantee a constant alignment of the feed belt 15.

Friction means can be associated with the guide rolls 16 for the same purpose.

Figure 3:
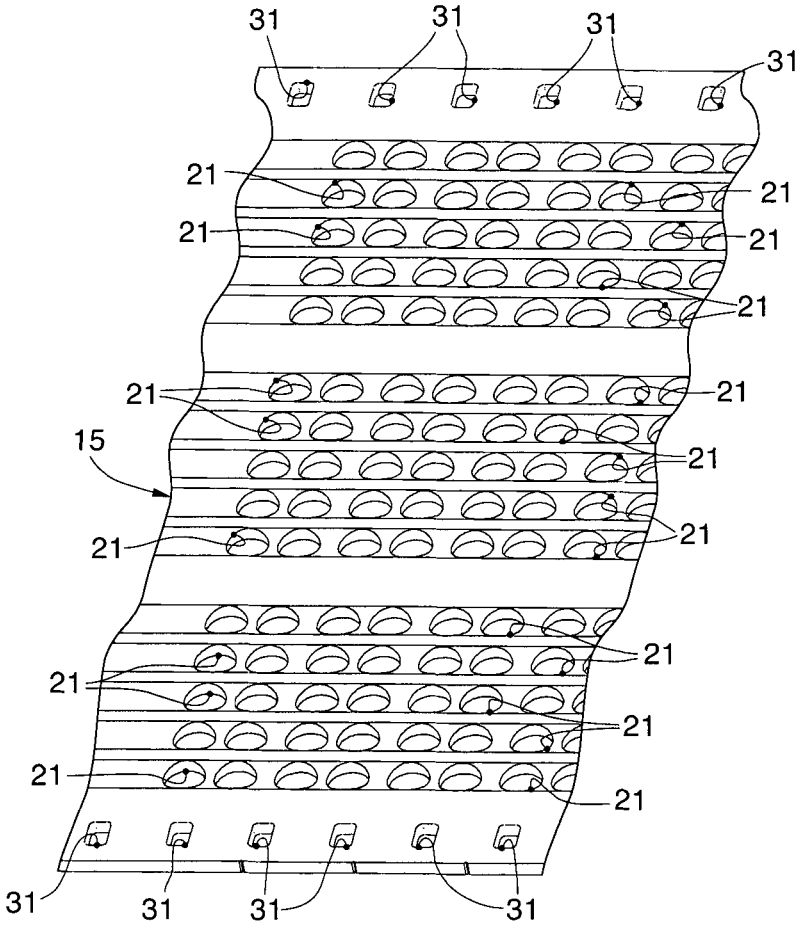
FIG. 3 is a three-dimensional view of a detail in FIG. 1.

In FIGS. 1-3, the engaging means as above comprise a plurality of teeth 30 disposed radially at the ends of at least one of the guide rolls 16, which engage in a series of corresponding cavities 31 made at the sides of the feed belt 15, which in this case is the continuous type.

Figure 5:
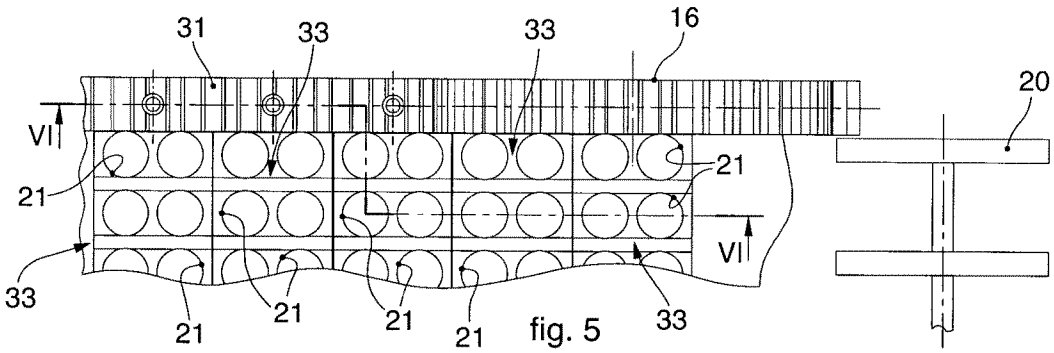
FIG. 5 is a plan view of a second form of embodiment of a part of FIG. 1.

FIGS. 5 and 6 show another form of embodiment, in which the engagement occurs between the teeth 30 of a guide roll 16 and a pair of toothed portions 32, positioned at the two sides of the feed belt 15. In this case, the toothed portions 32 are continuous and flexible, so as to wind around the guide roll 16, while the feed belt 15 is the type with blocks, and consists by way of example of a plurality of consecutive plates 33, each of which comprises two transverse rows of open through seatings 21.

Figure 7:
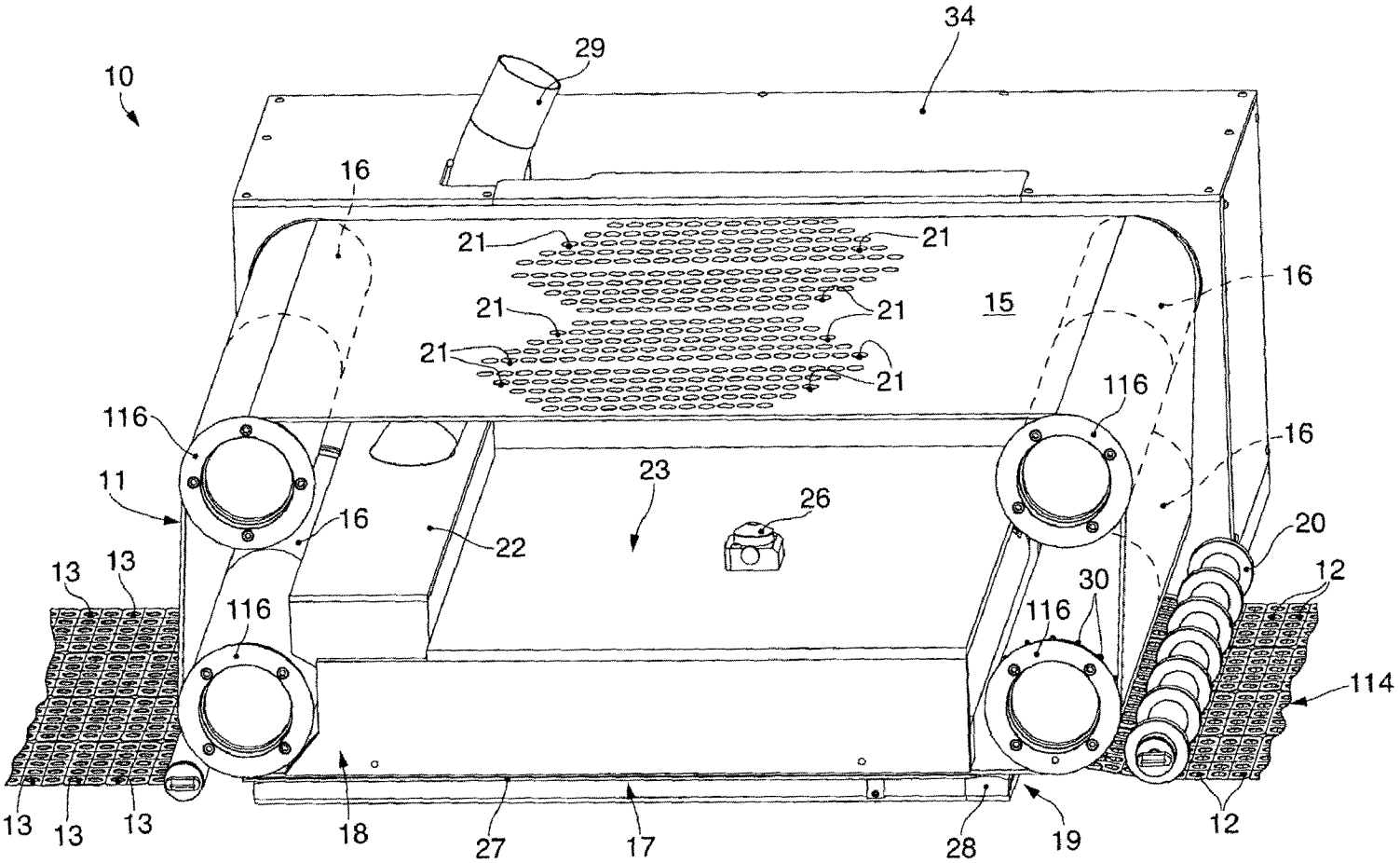
FIG. 7 is a variant of FIG. 1.

FIG. 7 shows, by way of example, a variant of FIG. 1, which differs from the latter because the length of the guide rolls 16 is greater. This greater length can be obtained with longer guide rolls 16, or with a series of extensions 116.

As it is possible to see from FIG. 7, the motor structure 34 is kept fixed and the other components are replaced on each occasion, so as to render them suitable for the requirements of the blister strip 14 to be filled.

With the present invention it is possible on each occasion to feed a blister strip 114 with its own width and disposition of the blisters 13 either by simply replacing the feed belt 15, or by replacing the other variable components of the system as well.

It is clear that modifications and/or additions of parts may be made to the distributor unit 10 as described heretofore, without departing from the field and scope of the present invention.

It is also clear that, although the present invention has been described with reference to some specific examples, a person of skill in the art shall certainly be able to achieve many other equivalent forms of distributor unit 10, having the characteristics as set forth in the claims and hence all coming within the field of protection defined thereby.

The invention claimed is:

1. A distributor unit for transferring tablets and putting them in order, from a loading zone to an unloading zone, and to distribute said tablets in an orderly and controlled manner in organized blisters present in a blister strip, comprising:

belt-type feed means, wherein the belt-type means comprise:

a feed belt with a length and a width, a plurality of open through seatings, disposed along at least part of the length of the feed belt and at least part of the width of the feed belt, a rectilinear segment extending between the loading zone and the unloading zone, wherein the rectilinear segment is a lower segment of the feed belt, wherein the loading zone and the unloading zone are located in the lower segment of the feed belt in the rectilinear segment, a support plane, located immediately under the feed belt to support the tablets received from the open through seatings at least for a segment of trajectory between the loading zone and unloading zone, and an upper pipe which delivers the tablets directly onto the feed belt at the loading zone, wherein the feed belt and the blister strip move adjacent and parallel to each other for the whole length of the rectilinear segment with the support plane disposed therebetween, wherein the open through seatings are sized to coordinate with different sizes of the tablets to be distributed, wherein a transverse interaxis of the open through seatings is about equal to a transverse interaxis of the blisters in the blister strip, and a longitudinal interaxis of the open through seatings is equal to or less than a longitudinal interaxis of the blisters in the blister strip.

2. The distributor unit of claim 1, wherein the feed belt and the blister strip have a common segment at least in said unloading zone, the feed belt being located above said blister strip.

3. The distributor unit of claim 1, wherein said feed belt is configured to follow a closed-ring trajectory having at least a rectilinear segment, comprised at least between at least said loading zone and said unloading zone.

4. The distributor unit of claim 1, wherein if the longitudinal interaxis of said open through seatings is different from the longitudinal interaxis of said blisters, the reciprocal speeds are different as a consequence of said difference in the longitudinal interaxis.

5. The distributor unit of claim 1, wherein downstream of said loading zone there are brush-type leveling and positioning means.

6. The distributor unit of claim 1, wherein said brush-type leveling and positioning means comprises brushes with a horizontal axis.

7. The distributor unit of claim 1 further comprising deflector means, located downstream of the unloading zone.

8. The distributor unit of claim 1, wherein downstream of said unloading zone there is at least a deflector roll.

9. The distributor unit of claim 1, wherein said feed belt is moved by movement means with which engaging means or friction means are associated.

10. The distributor unit of claim 1 further comprising a motor structure, the components associated with said feed belt being replaceable.

11. The distributor unit of claim 1, wherein in the rectilinear segment between the loading zone and the unloading zone, toward the unloading zone, control means are present.

12. The distributor unit of claim 1, wherein the loading zone and the unloading zone are provided in correspondence to the same rectilinear segment of the feed belt.

13. The distributor unit of claim 1 further comprising ordering means configured to position a single tablet in each of the open through seatings.

14. The distributor unit of claim 13, wherein at least the ordering means are included inside the linear segment of the closed-ring trajectory of the feed belt.

15. The distributor unit of claim 14, wherein at least part of a hopper is included inside the closed-ring trajectory of the feed belt.

16. The distributor unit of claim 13, wherein the ordering means extend between the loading zone and the unloading zone and above the rectilinear segment.

17. The distributor unit of claim 1, wherein said brush-type leveling and positioning means comprises brushes with a vertical axis and/or linear brushes.

18. The distributor unit of claim 1, wherein said brush-type leveling and positioning means comprises linear brushes.

19. A method for transferring tablets and putting them in order, from a loading zone to an unloading zone, and for distributing said tablets in an orderly and controlled manner in organized blisters present in a blister strip, using a distributor unit as in any claim hereinbefore, comprising the steps of feeding the tablets to the blister strip by means of feed means which house the tablets in a plurality of open through seatings of a feed belt, each having sizes coordinated with those of the tablets to be distributed, and a transverse interaxis about equal to, and a longitudinal interaxis equal to or less than, that of said blisters in said blister strip, said feed belt passing above the blister strip and being reciprocally associated at least in the unloading zone.

* * * * *